US010325547B2

(12) United States Patent
Kim et al.

(10) Patent No.: US 10,325,547 B2
(45) Date of Patent: Jun. 18, 2019

(54) DISPLAY DEVICE AND METHOD OF COMPENSATING DEGRADATION OF A DISPLAY PANEL

(71) Applicant: SAMSUNG DISPLAY CO., LTD., Yongin-si, Gyeonggi-do (KR)

(72) Inventors: Min-Cheol Kim, Asan-si (KR); In-Hwan Kim, Asan-si (KR); Byung-Geun Jun, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 459 days.

(21) Appl. No.: 15/134,255

(22) Filed: Apr. 20, 2016

(65) Prior Publication Data

US 2017/0053587 A1 Feb. 23, 2017

(30) Foreign Application Priority Data

Aug. 21, 2015 (KR) ..... 10-2015-0118259

(51) Int. Cl.
*G09G 3/30* (2006.01)
*G09G 3/20* (2006.01)
*G09G 3/10* (2006.01)

(52) U.S. Cl.
CPC ... *G09G 3/2092* (2013.01); *G09G 2320/0233* (2013.01); *G09G 2320/0242* (2013.01); *G09G 2320/0271* (2013.01); *G09G 2320/0285* (2013.01); *G09G 2320/0295* (2013.01); *G09G 2320/043* (2013.01); *G09G 2360/16* (2013.01)

(58) Field of Classification Search
CPC ..... G09G 3/3233; G09G 3/2092
USPC ..... 345/76; 315/169.3
See application file for complete search history.

(56) References Cited

U.S. PATENT DOCUMENTS

2004/0201582 A1* 10/2004 Mizukoshi ..... G09G 3/3233 345/211
2005/0029968 A1* 2/2005 Shimoda ..... G09G 3/3283 315/293
2005/0052350 A1* 3/2005 Mizukoshi ..... G09G 3/3233 345/55
2008/0024526 A1* 1/2008 Ko ..... G09G 3/3233 345/690
2010/0007656 A1* 1/2010 Okamoto ..... G09G 3/3233 345/214
2010/0103083 A1* 4/2010 Shin ..... G09G 3/3208 345/76
2010/0141667 A1* 6/2010 Chiou ..... G09G 3/3233 345/536
2010/0149226 A1* 6/2010 Byun ..... G09G 3/3225 345/690

(Continued)

FOREIGN PATENT DOCUMENTS

JP 2015049399 A * 3/2015 ..... G09G 3/3233

*Primary Examiner* — Adam J Snyder
(74) *Attorney, Agent, or Firm* — Lewis Roca Rothgerber Christie LLP

(57) ABSTRACT

A display device includes a display panel that includes a pixel, a current sensor that measures a driving current provided to the display panel, and a timing controller that calculates a reference driving current and a degradation ratio of the pixel based on first image data provided to the display panel and compensates second image data based on the driving current, the reference driving current, and the degradation ratio of the pixel.

19 Claims, 14 Drawing Sheets

(56) References Cited

U.S. PATENT DOCUMENTS

2011/0157152 A1* 6/2011 Byun ..... G09G 3/3233
345/214
2014/0028734 A1* 1/2014 Fujishiro ..... G09G 3/20
345/690

* cited by examiner

| GRAY | Wsc [mA] | Rsc [mA] | Gsc [mA] | Bsc [mA] | Wmc [mA] |
|---|---|---|---|---|---|
| 255 | 101.3698 | 23.6698 | 31.9698 | 57.7698 | 113.4094 |
| 203 | 59.1689 | 13.0698 | 17.2698 | 33.8698 | 64.2094 |
| 127 | 20.1698 | 3.9698 | 5.3698 | 11.4698 | 20.8094 |
| 63 | 4.3698 | 0.7698 | 0.9698 | 2.4698 | 4.2094 |
| 31 | 0.9698 | 0.0000 | 0.1698 | 0.4698 | 0.6396 |

FIG. 4B

420

| GRAY | Wsc_Log | Wmc_Log | RofWmc | GofWmc | BofWmc | Rmc | Gmc | Bmc |
|---|---|---|---|---|---|---|---|---|
| | [mA] | [mA] | [na] | [na] | [na] | [mA] | [mA] | [mA] |
| . . . | . . . | . . . | . . . | . . . | . . . | . . . | . . . | . . . |
| 228 | 77.8338 | 85.7848 | 0.2060 | 0.2752 | 0.5188 | 17.6743 | 23.6063 | 44.5042 |
| 229 | 78.6421 | 86.7264 | 0.2061 | 0.2754 | 0.5184 | 17.8769 | 23.8870 | 44.9625 |
| 230 | 79.4552 | 87.6741 | 0.2062 | 0.2757 | 0.5181 | 18.0810 | 24.1698 | 45.4233 |
| 231 | 80.2731 | 88.6281 | 0.2063 | 0.2759 | 0.5177 | 18.2865 | 24.4548 | 45.8867 |
| 232 | 81.0959 | 89.5882 | 0.2064 | 0.2762 | 0.5174 | 18.4935 | 24.7420 | 46.3526 |
| . . . | . . . | . . . | . . . | . . . | . . . | . . . | . . . | . . . |

FIG. 4D

440

433

RED

| 1 | 2 | 3 | 4 | 5 | 6 | 7 | 8 | 9 | 10 |
|---|---|---|---|---|---|---|---|---|---|
| 194 | 194 | 194 | 194 | 194 | 194 | 194 | 194 | 194 | 194 |
| 194 | 194 | 200 | 200 | 200 | 200 | 200 | 194 | 194 | 194 |
| 194 | 194 | 194 | 194 | 194 | 194 | 194 | 194 | 194 | 194 |
| 194 | 194 | 194 | 194 | 194 | 194 | 194 | 194 | 194 | 194 |
| 194 | 194 | 200 | 200 | 200 | 200 | 200 | 194 | 194 | 194 |
| 194 | 194 | 200 | 200 | 200 | 200 | 200 | 194 | 194 | 194 |
| 194 | 194 | 194 | 194 | 194 | 194 | 194 | 194 | 194 | 194 |
| 194 | 194 | 194 | 194 | 194 | 194 | 194 | 194 | 194 | 194 |
| 194 | 194 | 197 | 197 | 197 | 197 | 197 | 194 | 194 | 194 |
| 194 | 194 | 194 | 194 | 194 | 194 | 194 | 194 | 194 | 194 |
| 1 | 2 | 3 | 4 | 5 | 6 | 7 | 8 | 9 | 10 |

441

195 AG1

GREEN

| 1 | 2 | 3 | 4 | 5 | 6 | 7 | 8 | 9 | 10 |
|---|---|---|---|---|---|---|---|---|---|
| 194 | 194 | 194 | 194 | 194 | 194 | 194 | 194 | 194 | 194 |
| 194 | 194 | 198 | 198 | 198 | 198 | 198 | 194 | 194 | 194 |
| 194 | 194 | 194 | 194 | 194 | 194 | 194 | 194 | 194 | 194 |
| 194 | 194 | 194 | 194 | 194 | 194 | 194 | 194 | 194 | 194 |
| 194 | 194 | 200 | 200 | 200 | 200 | 200 | 194 | 194 | 194 |
| 194 | 194 | 200 | 200 | 200 | 200 | 200 | 194 | 194 | 194 |
| 194 | 194 | 194 | 194 | 194 | 194 | 194 | 194 | 194 | 194 |
| 194 | 194 | 194 | 194 | 194 | 194 | 194 | 194 | 194 | 194 |
| 194 | 194 | 197 | 197 | 197 | 197 | 197 | 194 | 194 | 194 |
| 194 | 194 | 194 | 194 | 194 | 194 | 194 | 194 | 194 | 194 |
| 1 | 2 | 3 | 4 | 5 | 6 | 7 | 8 | 9 | 10 |

442

195 AG2

BLUE

| 1 | 2 | 3 | 4 | 5 | 6 | 7 | 8 | 9 | 10 |
|---|---|---|---|---|---|---|---|---|---|
| 194 | 194 | 194 | 194 | 194 | 194 | 194 | 194 | 194 | 194 |
| 194 | 194 | 198 | 198 | 198 | 198 | 198 | 194 | 194 | 194 |
| 194 | 194 | 194 | 194 | 194 | 194 | 194 | 194 | 194 | 194 |
| 194 | 194 | 194 | 194 | 194 | 194 | 194 | 194 | 194 | 194 |
| 194 | 194 | 200 | 200 | 200 | 200 | 200 | 194 | 194 | 194 |
| 194 | 194 | 200 | 200 | 200 | 200 | 200 | 194 | 194 | 194 |
| 194 | 194 | 194 | 194 | 194 | 194 | 194 | 194 | 194 | 194 |
| 194 | 194 | 194 | 194 | 194 | 194 | 194 | 194 | 194 | 194 |
| 194 | 194 | 198 | 198 | 198 | 198 | 198 | 194 | 194 | 194 |
| 194 | 194 | 194 | 194 | 194 | 194 | 194 | 194 | 194 | 194 |
| 1 | 2 | 3 | 4 | 5 | 6 | 7 | 8 | 9 | 10 |

443

195 AG3

FIG. 4E

450

451a

RED

| 1 | 2 | 3 | 4 | 5 | 6 | 7 | 8 | 9 | 10 |
|---|---|---|---|---|---|---|---|---|---|
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0119 | 0.0119 | 0.0119 | 0.0119 | 0.0119 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0114 | 0.0114 | 0.0114 | 0.0114 | 0.0114 | 0.0097 | 0.0097 | 0.0097 |
| 0.0097 | 0.0097 | 0.0114 | 0.0114 | 0.0114 | 0.0114 | 0.0114 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0104 | 0.0104 | 0.0104 | 0.0104 | 0.0104 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 1 | 2 | 3 | 4 | 5 | 6 | 7 | 8 | 9 | 10 |

451

GREEN

| 1 | 2 | 3 | 4 | 5 | 6 | 7 | 8 | 9 | 10 |
|---|---|---|---|---|---|---|---|---|---|
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0109 | 0.0109 | 0.0109 | 0.0109 | 0.0109 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0119 | 0.0119 | 0.0119 | 0.0119 | 0.0119 | 0.0097 | 0.0097 | 0.0097 |
| 0.0097 | 0.0097 | 0.0119 | 0.0119 | 0.0119 | 0.0119 | 0.0119 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0104 | 0.0104 | 0.0104 | 0.0104 | 0.0104 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 1 | 2 | 3 | 4 | 5 | 6 | 7 | 8 | 9 | 10 |

452

BLUE

| 1 | 2 | 3 | 4 | 5 | 6 | 7 | 8 | 9 | 10 |
|---|---|---|---|---|---|---|---|---|---|
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0107 | 0.0107 | 0.0107 | 0.0107 | 0.0107 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0119 | 0.0118 | 0.0118 | 0.0118 | 0.0118 | 0.0097 | 0.0097 | 0.0097 |
| 0.0097 | 0.0097 | 0.0119 | 0.0118 | 0.0118 | 0.0118 | 0.0118 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 0.0097 | 0.0097 | 0.0107 | 0.0107 | 0.0107 | 0.0107 | 0.0107 | 0.0097 | 0.0097 | 0.0097 |
| 0.0097 | 0.0097 | 0.0097 | 0.0097 | 0.0097 | 0.0097 | 0.0097 | 0.0097 | 0.0097 | 0.0097 |
| 1 | 2 | 3 | 4 | 5 | 6 | 7 | 8 | 9 | 10 |

453

FIG. 4F

NORMALIZATION

| COURT DATA NORMALIZATION | | |
|---|---|---|
| R_COURTNORM | G_COURTNORM | B_COURTNORM |
| 195 (533a) | 195 | 195 |
| | | |
| COURT DATA NORMALIZATION | | |
| R_COURTRATIONORM | G_COURTRATIONORM | B_COURTRATIONORM |
| 0.3335 | 0.3333 | 0.3334 |

IREF

| RESULT | |
|---|---|
| WMC_REF | |
| 56.0835 | |

ISEN

| WMC_COURT_SIMBURN | |
|---|---|
| 50.1241 | |

ΔI

| WMC_BURNDELTA | |
|---|---|
| [mA] | |
| 5.9595 | |

ΔI_RGB

| R_BURNDELTA | G_BURNDELTA | B_BURNDELTA |
|---|---|---|
| 1.9875 | 1.9863 | 1.9869 |

FIG. 4G

470

471

RED

| | 1 | 2 | 3 | 4 | 5 | 6 | 7 | 8 | 9 | 10 | |
|---|---|---|---|---|---|---|---|---|---|---|---|
| 1 | 0.019300 | 0.019300 | 0.019300 | 0.019300 | 0.019300 | 0.019300 | 0.019300 | 0.019300 | 0.019300 | 0.019300 | 1 |
| 2 | 0.019300 | 0.019300 | 0.023700 | 0.023700 | 0.023700 | 0.023700 | 0.023700 | 0.019300 | 0.019300 | 0.019300 | 2 |
| 3 | 0.019300 | 0.019300 | 0.019300 | 0.019300 | 0.019300 | 0.019300 | 0.019300 | 0.019300 | 0.019300 | 0.019300 | 3 |
| 4 | 0.019300 | 0.019300 | 0.019300 | 0.019300 | 0.019300 | 0.019300 | 0.019300 | 0.019300 | 0.019300 | 0.019300 | 4 |
| 5 | 0.019300 | 0.019300 | 0.022700 | 0.022700 | 0.022700 | 0.022700 | 0.022700 | 0.019300 | 0.019300 | 0.019300 | 5 |
| 6 | 0.019300 | 0.019300 | 0.022700 | 0.022700 | 0.022700 | 0.022700 | 0.022700 | 0.019300 | 0.019300 | 0.019300 | 6 |
| 7 | 0.019300 | 0.019300 | 0.019300 | 0.019300 | 0.019300 | 0.019300 | 0.019300 | 0.019300 | 0.019300 | 0.019300 | 7 |
| 8 | 0.019300 | 0.019300 | 0.019300 | 0.019300 | 0.019300 | 0.019300 | 0.019300 | 0.019300 | 0.019300 | 0.019300 | 8 |
| 9 | 0.019300 | 0.019300 | 0.020700 | 0.020700 | 0.020700 | 0.020700 | 0.020700 | 0.019300 | 0.019300 | 0.019300 | 9 |
| 10 | 0.019300 | 0.019300 | 0.019300 | 0.019300 | 0.019300 | 0.019300 | 0.019300 | 0.019300 | 0.019300 | 0.019300 | 10 |
| | 1 | 2 | 3 | 4 | 5 | 6 | 7 | 8 | 9 | 10 | |

GREEN

| | 1 | 2 | 3 | 4 | 5 | 6 | 7 | 8 | 9 | 10 | |
|---|---|---|---|---|---|---|---|---|---|---|---|
| 1 | 0.019300 | 0.019300 | 0.019300 | 0.019300 | 0.019300 | 0.019300 | 0.019300 | 0.019300 | 0.019300 | 0.019300 | 1 |
| 2 | 0.019300 | 0.019300 | 0.021700 | 0.021700 | 0.021700 | 0.021700 | 0.021700 | 0.019300 | 0.019300 | 0.019300 | 2 |
| 3 | 0.019300 | 0.019300 | 0.019300 | 0.019300 | 0.019300 | 0.019300 | 0.019300 | 0.019300 | 0.019300 | 0.019300 | 3 |
| 4 | 0.019300 | 0.019300 | 0.019300 | 0.019300 | 0.019300 | 0.019300 | 0.019300 | 0.019300 | 0.019300 | 0.019300 | 4 |
| 5 | 0.019300 | 0.019300 | 0.023700 | 0.023700 | 0.023700 | 0.023700 | 0.023700 | 0.019300 | 0.019300 | 0.019300 | 5 |
| 6 | 0.019300 | 0.019300 | 0.023700 | 0.023700 | 0.023700 | 0.023700 | 0.023700 | 0.019300 | 0.019300 | 0.019300 | 6 |
| 7 | 0.019300 | 0.019300 | 0.019300 | 0.019300 | 0.019300 | 0.019300 | 0.019300 | 0.019300 | 0.019300 | 0.019300 | 7 |
| 8 | 0.019300 | 0.019300 | 0.019300 | 0.019300 | 0.019300 | 0.019300 | 0.019300 | 0.019300 | 0.019300 | 0.019300 | 8 |
| 9 | 0.019300 | 0.019300 | 0.020700 | 0.020700 | 0.020700 | 0.020700 | 0.020700 | 0.019300 | 0.019300 | 0.019300 | 9 |
| 10 | 0.019300 | 0.019300 | 0.019300 | 0.019300 | 0.019300 | 0.019300 | 0.019300 | 0.019300 | 0.019300 | 0.019300 | 10 |
| | 1 | 2 | 3 | 4 | 5 | 6 | 7 | 8 | 9 | 10 | |

BLUE

| | 1 | 2 | 3 | 4 | 5 | 6 | 7 | 8 | 9 | 10 | |
|---|---|---|---|---|---|---|---|---|---|---|---|
| 1 | 0.019300 | 0.019300 | 0.019300 | 0.019300 | 0.019300 | 0.019300 | 0.019300 | 0.019300 | 0.019300 | 0.019300 | 1 |
| 2 | 0.019300 | 0.019300 | 0.021300 | 0.021300 | 0.021300 | 0.021300 | 0.021300 | 0.019300 | 0.019300 | 0.019300 | 2 |
| 3 | 0.019300 | 0.019300 | 0.019300 | 0.019300 | 0.019300 | 0.019300 | 0.019300 | 0.019300 | 0.019300 | 0.019300 | 3 |
| 4 | 0.019300 | 0.019300 | 0.019300 | 0.019300 | 0.019300 | 0.019300 | 0.019300 | 0.019300 | 0.019300 | 0.019300 | 4 |
| 5 | 0.019300 | 0.019300 | 0.023500 | 0.023500 | 0.023500 | 0.023500 | 0.023500 | 0.019300 | 0.019300 | 0.019300 | 5 |
| 6 | 0.019300 | 0.019300 | 0.023500 | 0.023500 | 0.023500 | 0.023500 | 0.023500 | 0.019300 | 0.019300 | 0.019300 | 6 |
| 7 | 0.019300 | 0.019300 | 0.019300 | 0.019300 | 0.019300 | 0.019300 | 0.019300 | 0.019300 | 0.019300 | 0.019300 | 7 |
| 8 | 0.019300 | 0.019300 | 0.019300 | 0.019300 | 0.019300 | 0.019300 | 0.019300 | 0.019300 | 0.019300 | 0.019300 | 8 |
| 9 | 0.019300 | 0.019300 | 0.021300 | 0.021300 | 0.021300 | 0.021300 | 0.021300 | 0.019300 | 0.019300 | 0.019300 | 9 |
| 10 | 0.019300 | 0.019300 | 0.019300 | 0.019300 | 0.019300 | 0.019300 | 0.019300 | 0.019300 | 0.019300 | 0.019300 | 10 |
| | 1 | 2 | 3 | 4 | 5 | 6 | 7 | 8 | 9 | 10 | |

FIG. 4H

480

481a

RED

| | 1 | 2 | 3 | 4 | 5 | 6 | 7 | 8 | 9 | 10 | |
|---|---|---|---|---|---|---|---|---|---|---|---|
| 1 | 10 | 10 | 10 | 10 | 10 | 10 | 10 | 10 | 10 | 10 | 1 |
| 2 | 10 | 10 | 12 | 12 | 12 | 12 | 12 | 10 | 10 | 10 | 2 |
| 3 | 10 | 10 | 10 | 10 | 10 | 10 | 10 | 10 | 10 | 10 | 3 |
| 4 | 10 | 10 | 10 | 10 | 10 | 10 | 10 | 10 | 10 | 10 | 4 |
| 5 | 10 | 10 | 12 | 12 | 12 | 12 | 12 | 10 | 10 | 10 | 5 |
| 6 | 10 | 10 | 12 | 12 | 12 | 12 | 12 | 10 | 10 | 10 | 6 |
| 7 | 10 | 10 | 10 | 10 | 10 | 10 | 10 | 10 | 10 | 10 | 7 |
| 8 | 10 | 10 | 10 | 10 | 10 | 10 | 10 | 10 | 10 | 10 | 8 |
| 9 | 10 | 10 | 11 | 11 | 11 | 11 | 11 | 10 | 10 | 10 | 9 |
| 10 | 10 | 10 | 10 | 10 | 10 | 10 | 10 | 10 | 10 | 10 | 10 |
| | 1 | 2 | 3 | 4 | 5 | 6 | 7 | 8 | 9 | 10 | |

481

GREEN

| | 1 | 2 | 3 | 4 | 5 | 6 | 7 | 8 | 9 | 10 | |
|---|---|---|---|---|---|---|---|---|---|---|---|
| 1 | 7 | 7 | 7 | 7 | 7 | 7 | 7 | 7 | 7 | 7 | 1 |
| 2 | 7 | 7 | 8 | 8 | 8 | 8 | 8 | 7 | 7 | 7 | 2 |
| 3 | 7 | 7 | 7 | 7 | 7 | 7 | 7 | 7 | 7 | 7 | 3 |
| 4 | 7 | 7 | 7 | 7 | 7 | 7 | 7 | 7 | 7 | 7 | 4 |
| 5 | 7 | 7 | 9 | 9 | 9 | 9 | 9 | 7 | 7 | 7 | 5 |
| 6 | 7 | 7 | 9 | 9 | 9 | 9 | 9 | 7 | 7 | 7 | 6 |
| 7 | 7 | 7 | 7 | 7 | 7 | 7 | 7 | 7 | 7 | 7 | 7 |
| 8 | 7 | 7 | 7 | 7 | 7 | 7 | 7 | 7 | 7 | 7 | 8 |
| 9 | 7 | 7 | 8 | 8 | 8 | 8 | 8 | 7 | 7 | 7 | 9 |
| 10 | 7 | 7 | 7 | 7 | 7 | 7 | 7 | 7 | 7 | 7 | 10 |
| | 1 | 2 | 3 | 4 | 5 | 6 | 7 | 8 | 9 | 10 | |

482

BLUE

| | 1 | 2 | 3 | 4 | 5 | 6 | 7 | 8 | 9 | 10 | |
|---|---|---|---|---|---|---|---|---|---|---|---|
| 1 | 3 | 3 | 3 | 3 | 3 | 3 | 3 | 3 | 3 | 3 | 1 |
| 2 | 3 | 3 | 4 | 4 | 4 | 4 | 4 | 3 | 3 | 3 | 2 |
| 3 | 3 | 3 | 3 | 3 | 3 | 3 | 3 | 3 | 3 | 3 | 3 |
| 4 | 3 | 3 | 3 | 3 | 3 | 3 | 3 | 3 | 3 | 3 | 4 |
| 5 | 3 | 3 | 4 | 4 | 4 | 4 | 4 | 3 | 3 | 3 | 5 |
| 6 | 3 | 3 | 4 | 4 | 4 | 4 | 4 | 3 | 3 | 3 | 6 |
| 7 | 3 | 3 | 3 | 3 | 3 | 3 | 3 | 3 | 3 | 3 | 7 |
| 8 | 3 | 3 | 3 | 3 | 3 | 3 | 3 | 3 | 3 | 3 | 8 |
| 9 | 3 | 3 | 4 | 4 | 4 | 4 | 4 | 3 | 3 | 3 | 9 |
| 10 | 3 | 3 | 3 | 3 | 3 | 3 | 3 | 3 | 3 | 3 | 10 |
| | 1 | 2 | 3 | 4 | 5 | 6 | 7 | 8 | 9 | 10 | |

483

DISPLAY DEVICE AND METHOD OF COMPENSATING DEGRADATION OF A DISPLAY PANEL

CROSS-REFERENCE TO RELATED APPLICATION(S)

This application claims priority under 35 USC § 119 to Korean Patent Application No. 10-2015-0118259, filed on Aug. 21, 2015 in the Korean Intellectual Property Office (KIPO), the content of which is incorporated herein in its entirety by reference.

BACKGROUND

1. Field

Example embodiments of the present invention relate to a display device.

2. Description of the Related Art

An organic light emitting display device displays an image using an organic light emitting diode. The organic light emitting diode and a driving transistor that transfers a current to the organic light emitting diode may degrade over time as the organic light emitting diode and the driving transistor are utilized. Thus, over time the organic light emitting display device may not display an image with the intended luminance due to degradation of the organic light emitting diode or degradation of the driving transistor.

A related art organic light emitting display device provides a reference voltage to each of a plurality of pixels, senses a current flowing through each of the pixels in response to the reference voltage, and calculates an amount of the degradation of the organic light emitting diode or an amount of the degradation of the driving transistor based on a sensed current. That is, the related art organic light emitting display device may include a relatively complex (or, complicated) current sensing configuration to sense the current of each of the pixels.

The above information disclosed in this Background section is only to enhance the understanding of the background of the invention, and therefore it may contain information that does not constitute prior art.

SUMMARY

Example embodiments of the present invention relate to a display device. For example, some embodiments of the present invention relate to a display device and a method of compensating degradation of a display panel.

Some example embodiments include a display device that includes a relatively simple current sensing configuration.

Some example embodiments provide a method of compensating for degradation (or, luminance degradation) of a display panel that can correctly (or, accurately) compensate for degradation of the display panel.

According to example embodiments, a display device includes: a display panel comprising a pixel; a current sensor configured to measure a driving current provided to the display panel; and a timing controller configured to calculate a reference driving current and a degradation ratio of the pixel based on first image data provided to the display panel and to compensate second image data based on the driving current, the reference driving current, and the degradation ratio of the pixel.

According to some embodiments, the display device further includes a power supply configured to provide first and second power voltages to the display panel through first and second power supply lines, wherein the current sensor is configured to measure the driving current that is returned from the display panel to the power supply through the second power supply line.

According to some embodiments, the first image data comprises frame images, and the timing controller is configured to generate average image data based on the frame images and to calculate the reference driving current and the degradation ratio based on the average image data.

According to some embodiments, the degradation ratio represents a ratio of an amount of luminance degradation of the pixel to an amount of luminance degradation of the display panel.

According to some embodiments, the timing controller is configured to calculate the degradation ratio based on a total sum of grayscales included in the first image data and a grayscale for the pixel among the grayscales.

According to some embodiments, the timing controller is configured to calculate an average grayscale based on grayscales included in the first image data and to calculate the reference driving current based on the average grayscale.

According to some embodiments, the timing controller comprises a look-up table comprising respective real driving current values for each of average grayscales of the first image data and is configured to determine the reference driving current by selecting one of the real driving current values based on the average grayscale.

According to some embodiments, the timing controller is configured to calculate a degradation current based on the reference driving current and the driving current.

According to some embodiments, the timing controller is configured to calculate a pixel degradation current of the pixel based on the degradation ratio and the degradation current.

According to some embodiments, the timing controller is configured to calculate an offset grayscale of the pixel based on the pixel degradation current, and the offset grayscale is added to a grayscale for the pixel included in the first image data.

According to some embodiments, the timing controller is configured to calculate a compensation grayscale curve that includes a degradation compensation value of the pixel for each of grayscales based on the offset grayscale.

According to some embodiments, the timing controller is configured to compensate the second image data based on the degradation compensation curve.

According to some embodiments, the timing controller is configured to compensate a degradation prediction profile based on the degradation current, and the degradation prediction profile comprises a luminance degradation rate of the display panel with time.

According to some embodiments, the timing controller is configured to calculate a degradation time constant, which represents a change of the degradation current with time, based on the degradation current and to compensate the degradation prediction profile based on the degradation time constant.

According to some embodiments of the present invention, a display device includes: a display panel comprising a pixel; a current sensor configured to measure a driving current provided to the display panel; and a timing controller configured to calculate a reference driving current based on first image data provided to the display panel, to calculate a degradation current based on the driving current and the reference driving current, and to compensate a degradation prediction profile based on the degradation current, wherein the degradation prediction profile comprises a luminance degradation rate of the display panel with time.

According to some embodiments, the timing controller is configured to calculate a degradation time constant, which represents a change of the degradation current with time, based on the degradation current and to compensate the degradation prediction profile based on the degradation time constant.

According to some embodiments, the timing controller is configured to compensate second image data based on a compensated degradation prediction profile.

According to some embodiments of the present invention, in a method of compensating a degradation of a display panel, the method includes: measuring a driving current provided to the display panel that comprises a pixel; calculating a degradation current based on the driving current and first image data that is provided to the display panel; calculating a pixel degradation current of the pixel based on the first image data and the degradation current; and compensating second image data based on the pixel degradation current.

According to some embodiments, calculating the degradation current includes: calculating a reference driving current based on the first image data; and calculating the degradation current based on a difference between the driving current and the reference driving current.

According to some embodiments, calculating the pixel degradation current includes: calculating a degradation ratio of the pixel based on the first image data; and calculating the pixel degradation current of the pixel based on the degradation current and the degradation ratio of the pixel.

Therefore, a display device according to example embodiments may correctly compensate for degradation (or, luminance degradation) of a display panel by sensing a total driving current of the display panel using a relatively simple current sensing configuration (e.g., employing one-channel current sensing technique) and by calculating a compensation grayscale (or, compensation data) for each of pixels based on the total driving current and input data that is provided to the display panel.

In addition, a method of compensating degradation of a display panel may correctly compensate for luminance degradation of the display panel (or, degradation of each of pixels) by calculating a degradation ratio of each of the pixels based on input data and by calculating a compensation grayscale for each of the pixel based on a calculated degradation ratio and a total driving current.

BRIEF DESCRIPTION OF THE DRAWINGS

Illustrative, non-limiting example embodiments will be more clearly understood from the following detailed description taken in conjunction with the accompanying drawings.

FIG. 4B is a diagram illustrating an example of a second look-up table included in the timing controller of FIG. 3.

FIG. 4D is a diagram illustrating another example of average image data generated by the timing controller of FIG. 3.

FIG. 4E is a diagram illustrating an example of a degradation ratio table generated by the timing controller of FIG. 3.

FIG. 4F is a diagram illustrating an operation of compensating unit included in the timing controller of FIG. 3.

FIG. 4G is a diagram illustrating an example of a pixel degradation current generated by the timing controller of FIG. 3.

FIG. 4H is a diagram illustrating an example of a compensation grayscale table generated by the timing controller of FIG. 3.

DETAILED DESCRIPTION

Figure 1:
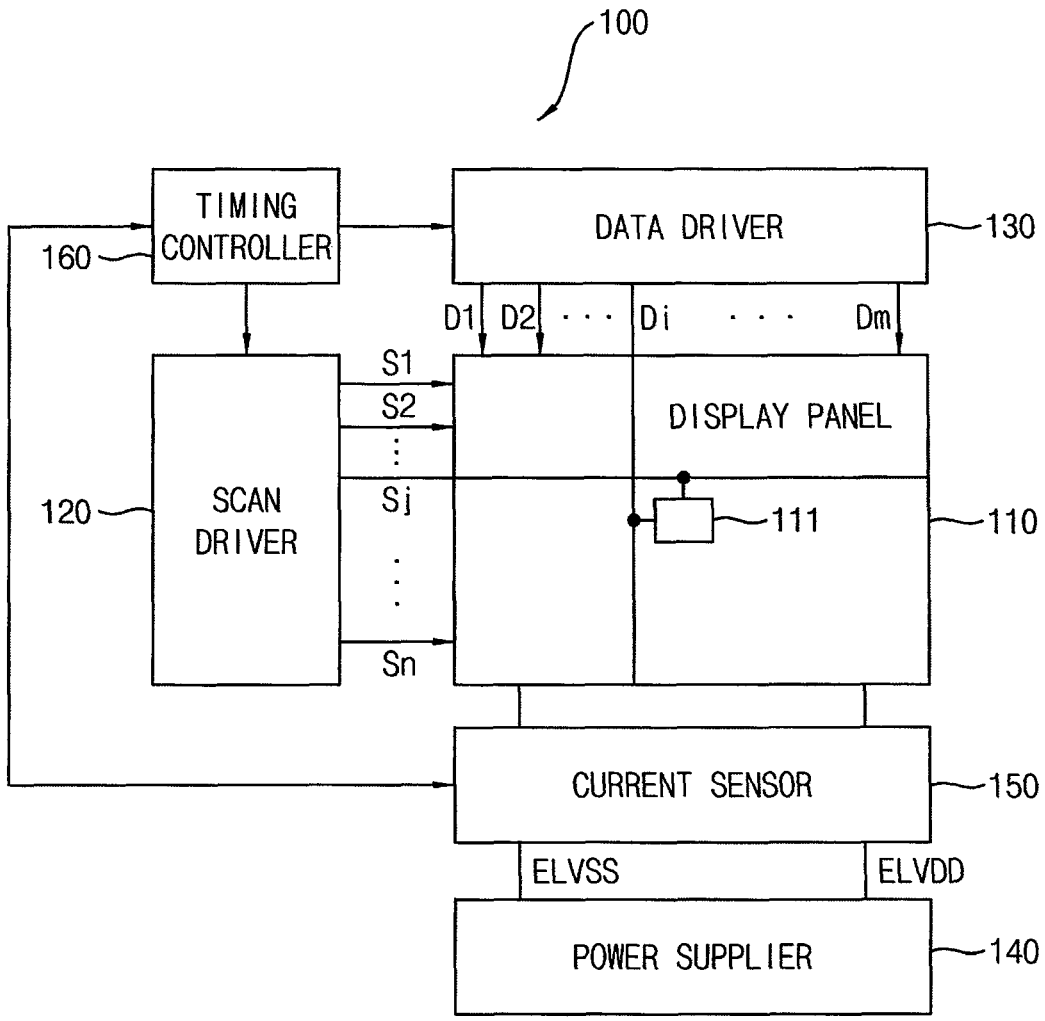
FIG. 1 is a block diagram illustrating a display device according to some example embodiments of the present invention.

Hereinafter, aspects of example embodiments of the present invention will be explained in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to some example embodiments of the present invention.

Referring to FIG. 1, the display device 100 may include a display panel 110, a scan driver 120, a data driver 130, a power supplier (or power supply) 140, a current sensor 150, and a timing controller 160. The display device 100 may display an image based on image data provided from an outside (or, an external) component or source. For example, the display device 100 may be an organic light emitting display device.

The display panel 110 may include scan lines S1 through Sn, data lines D1 through Dm, and pixels 111 disposed in pixel regions. Here, the pixel regions may be cross-regions of the scan lines S1 through Sn and the data lines D1 through Dm, where each of m and n is an integer greater than or equal to 2.

Each of the pixels 111 may store a data signal in response to a scan signal and may emit light based on a stored data signal. Here, the scan signal may be provided from the scan driver 120 to the pixels 111 through the scan lines S1 through Sn, and the data signal may be provided from the data driver 130 to the pixels through the data lines D1 through Dm.

The scan driver 120 may generate the scan signal based on the scan driving control signal. The scan driving control signal may be provided from the timing controller 130 to the scan driver 120. Here, the scan driving control signal may include a start pulse and clock signals, and the scan driver 120 may include a shift register sequentially generating the scan signal based on the start pulse and the clock signals.

The data driver 130 may generate the data signal based on the image data. The data driver 130 may provide a generated data signal to the display panel 110 in response to a data driving control signal. Here, the data driving control signal may be provided from the timing controller 160 to the data driver 130.

The power supplier 140 may generate a driving voltage to drive the display device 100. The driving voltage may include a first power voltage ELVDD and a second power voltage ELVSS. The first power voltage ELVDD may be greater than the second power voltage ELVSS. The power supplier 140 may supply the first and second power voltages ELVDD and ELVSS to the display panel 110 through first and second power supplying (or first and second power supply) lines.

The current sensor 150 may measure (or, sense, detect) a driving current (or, a total driving current) supplied to the display panel 110. The current sensor 150 may measure a returned current (or, a feedback current) that is returned from the display panel 110 to the power supplier 140 through the second power supplying line. A configuration of the current sensor 150 will be described in more detail with reference to FIG. 2.

The timing controller 160 may calculate a reference driving current (or, an ideal driving current) and a degradation ratio of each of the pixels 111 based on the image data, and may compensate the image data based on the driving current (e.g., the driving current measured by the current sensor 150), the reference driving current, and the degradation ratio of each of the pixels 111. In some example embodiments, the timing controller 160 may calculate the reference driving current based on the image data and may calculate a degradation current (or, a total degradation current of the pixels 111) based on the measured driving current (measured by the current sensor 150) and the reference driving current.

Here, the degradation current may be a difference between the measured driving current and the reference driving current due to degradation of the pixels 111. In some example embodiments, the timing controller 160 may calculate the degradation ratio of each of the pixels 111 based on the image data, may calculate a pixel degradation current of each of the pixels 111 based on the degradation current and the degradation ratio, and may calculate an offset grayscale of each of the pixels 111 based on the pixel degradation current. Here, the degradation ratio may represent a relative degradation degree between the pixels 111. For example, the degradation ratio of a certain pixel may be a ratio of an amount of degradation of the certain pixel to an amount of degradation of all the pixels 111 (or, the display panel 110). The timing controller 160 may compensate the image data based on the offset grayscale, where the offset grayscale may be added to a grayscale for a pixel to offset (or, compensate for) a luminance reduction due to the pixel degradation.

In some example embodiments, the timing controller 160 may calculate an average grayscale based on grayscales included in the image data and may calculate the reference driving current based on the average grayscale and a look-up table, where the look-up table may include a real driving current that is measured for each of grayscales of the image data. The timing controller 160 may obtain the reference driving current corresponding to the average grayscale from the look-up table.

In some example embodiments, the timing controller 160 may calculate the degradation current based on the reference driving current and the measured driving current. For example, the timing controller 160 may calculate the degradation current by calculating a difference between the reference driving current and the measured driving current.

In some example embodiments, the timing controller 160 may calculate the degradation ratio of each of the pixels 111 based on sum of grayscales included in the image data (e.g., a total grayscale) and a grayscale for each of the pixels 111 among the grayscales. For example, when a first grayscale of a first pixel is 50 and a second grayscale of a second pixel is 150, the timing controller 160 may calculate the total grayscale as 200 and may calculate a first degradation ratio of the first pixel as 0.25 (i.e., 50/200=0.25) and a second degradation ratio of the second pixel as 0.75 (e.g., 150/200=0.75).

In some example embodiments, the timing controller 160 may calculate the pixel degradation current of each of the pixels 111 based on the degradation ratio of each of the pixels 111. For example, the timing controller 160 may calculate the pixel degradation current by multiplying the degradation ratio of each of the pixels 111 with the degradation current.

In some example embodiments, the timing controller 160 may calculate the offset grayscale of each of the pixels 111 based on the pixel degradation current and a grayscale-current characteristic of a pixel (e.g., variation characteristic of the driving current according to a variation of a grayscale).

In some example embodiments, the timing controller 160 may include a degradation predicting profile and may compensate the degradation predicting profile based on the degradation current. Here, the degradation predicting profile may include a change of the degradation current in time (or, with time) and the change of the degradation current may be pre-determined. That is, the degradation prediction profile may include luminance degradation rate of the display panel with time.

The timing controller 160 may predict the pixel degradation (or, an amount of degradation of the pixel) based on the degradation predicting profile and may generate compensated image data that is compensated based on a predicted pixel degradation. Because a characteristic of the pixel degradation may be changed according to a change of a driving condition (e.g., a temperature) of the display device 100, the timing controller 160 may compensate the degradation predicting profile to correctly predict the pixel degradation based on a calculated degradation current (e.g., a real degradation current). In an example embodiment, the timing controller 160 may calculate a degradation time constant, which represents a change of the degradation current with time, based on the degradation current and may compensate the degradation predicting profile based on the degradation time constant.

The timing controller 160 may compensate the image data based on a compensated degradation predicting profile.

As described above, the display device 100 according to example embodiments may measure the total driving current that is supplied to the display panel 110, may calculate the degradation ratio of each of the pixels 111 and the reference driving current (or, ideal driving current) based on the image data, and may calculate the offset grayscale of each of the pixels 111 based on the total driving current, the reference driving current, and the degradation ratio of each of the pixels 111. Therefore, the display device 100 may respectively compensate for degradation of pixels 111 using a relatively simple configuration (or, a relatively simple current sensing configuration).

In addition, the display device 100 may compensate the degradation predicting profile based on a measured total driving current. Therefore, the display device 100 may correctly compensate for the pixel degradation considering (e.g., based on or according to) a change of the driving condition of the display device 100.

Figure 2:
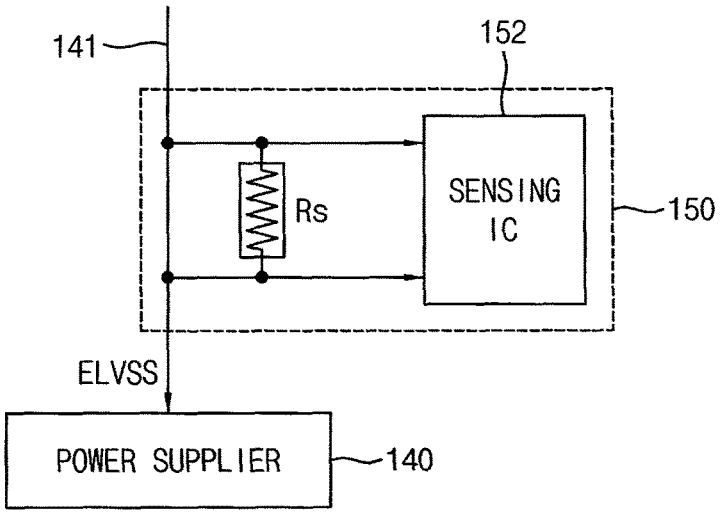
FIG. 2 is a diagram illustrating an example of a current sensor included in the display device of FIG. 1.

FIG. 2 is a diagram illustrating an example of a current sensor included in the display device of FIG. 1.

Referring to FIG. 2, the current sensor 150 may include a resistor Rs and a current sensing unit 152 (or, a sensing integrated circuit). The resistor Rs may be electrically connected in parallel to a second power supplying line 141. The current sensing unit 152 may measure a driving current based on a voltage (or, a voltage drop) across the resistor Rs. Here, the driving current may be a returned current that is returned from the display panel 110 to the power supplier 140. For example, the current sensing unit 152 may amplify the voltage across the resistor Rs and may output an amplified voltage.

As described above, the current sensor 150 may include one-channel current sensing configuration. The one-channel current sensing configuration is simpler than a two-channel current sensing configuration (e.g., a configuration that has a voltage supplying configuration and a current measuring configuration).

Figure 3:
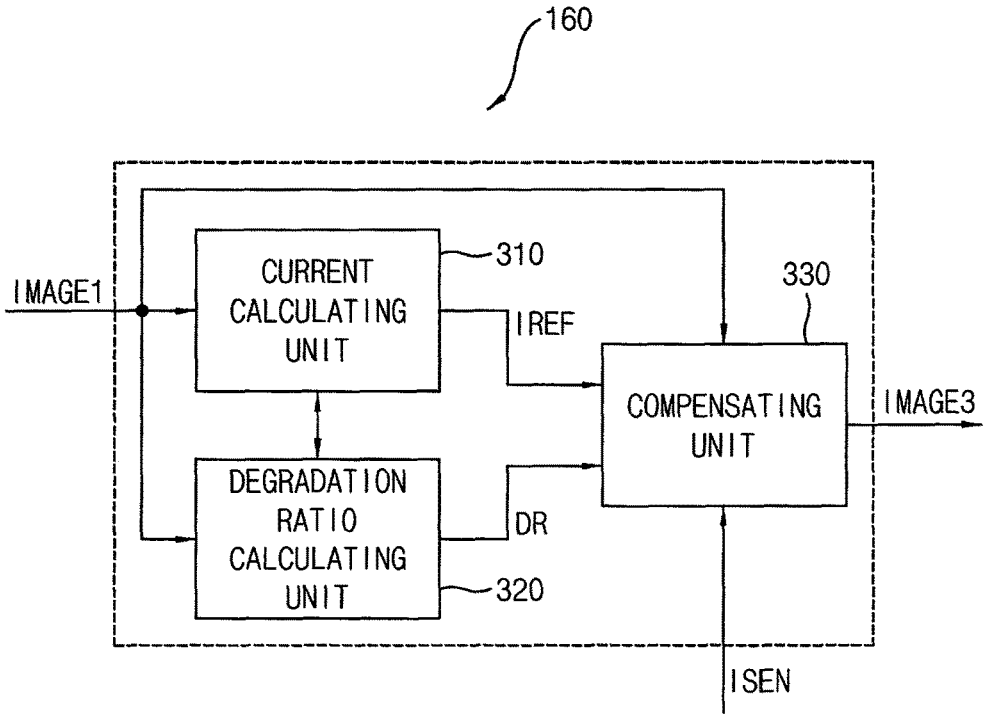
FIG. 3 is a diagram illustrating an example of a timing controller included in the display device of FIG. 1.

FIG. 3 is a diagram illustrating an example of a timing controller included in the display device of FIG. 1.

Referring to FIG. 3, the timing controller may include a reference current calculating unit 310, a degradation ratio calculating unit 320, and a compensating unit 330.

The reference current calculating unit 310 may calculate a reference driving current IREF based on grayscales included in first image data IMAGE1. Here, the first image data IMAGE1 may be image data supplied from an outside (or, an external) component at a certain time (e.g., a predetermined time) or during a certain period (e.g., a predetermined period). For example, the first image data IMAGE1 may include a frame image corresponding to the certain time or frame images supplied during the certain period. In some example embodiments, the reference current calculating unit 310 may include a look-up table, where the look-up table may include a real driving current that is pre-measured for grayscales of the first input data IMAGE1.

Figure 4A:
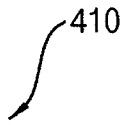
FIG. 4A is a diagram illustrating an example of a first look-up table included in the timing controller of FIG. 3.

FIG. 4A is a diagram illustrating an example of a first look-up table included in the timing controller of FIG. 3. Here, the first look-up table 410 may be used to calculate a driving current of each grayscale.

Referring to FIG. 4A, the first look-up table 410 may include a total driving current Wmc corresponding to a grayscale Gray of image data. The total driving current Wmc may be calculated by summing a first current Rsc, a second current Gsc, and a third current Bsc, where the first through third currents Rsc, Gsc, and Bsc may be total driving currents that is respectively measured for sub pixels included in the pixels 111.

For example, when each of the pixels 111 includes a first sub pixel to display a first color, a second sub pixel to display a second color, and a third sub pixel to display a third color, the first current Rsc may be a first total driving current supplied to the first sub pixels included in the display panel 110, the second current Gsc may be a second total driving current supplied to the second sub pixels included in the display panel 110, and the third current Bsc may be a third total driving current supplied to the third sub pixels included in the display panel 110.

As illustrated in FIG. 4A, the total driving current Wmc corresponding to a grayscale of 255 may be 113.4094 mill ampere (mA) that is sum of 23.6698 mill ampere (mA) of the first current Rsc, 31.9698 mill ampere (mA) of the second current Gsc, and 57.7698 mill ampere (mA) of the third current Bsc.

For reference, a loading effect may exist between the first through third currents Rsc, Gsc, and Bsc. That is, other currents may be changed according to a change of a certain current. For example, when grayscales of the first through third sub pixels are 255, the total driving current Wmc may be measured as not 113.4074 mill ampere (mA) but 101.3698 mill ampere (mA).

However, the first look-up table 410 may include the first through the third currents and the total driving current that do not consider the loading effects between the currents because manufacturing cost of the display device 100 is increased when the first look-up table 410 includes values considering all cases of the loading effects (e.g., 256*256*256 number of cases).

The first through third currents Rsc, Gsc, and Bsc may be measured at a manufacturing process of the display panel 110 and may be stored in a storage device (e.g., ROM) included in the timing controller 160. In an example embodiment, the first look-up table 410 may include the first through third currents Rsc, Gsc, and Bsc that are measured for all grayscales (e.g., grayscales in a range of 0 through 255) of the image data. In an example embodiment, the first look-up table 410 may include the first through third currents Rsc, Gsc, and Bsc that are measured for only some grayscales (e.g., 31, 63, 127, 203, and 255). Here, the first through third currents Rsc, Gsc, and Bsc corresponding to other grayscales may be calculated based on measured currents. For example, the first through third currents Rsc, Gsc, and Bsc may be calculated by a general gamma equation or a linear equation.

FIG. 4B is a diagram illustrating an example of a second look-up table included in the timing controller of FIG. 3. Here, the second look-up table 420 may be used to calculate a driving current of each grayscale.

Referring to FIGS. 4A and 4B, the second look-up table 420 may include the first through third currents Rsc, Gsc, and Bsc and total driving currents Wmc_Log for all grayscales. Here, the first through third currents Rsc, Gsc, and Bsc and the total driving currents Wmc_Log for a range of a grayscale 228 through a grayscale 232 may be calculated based on those for a grayscale 203 and those for a grayscale 255.

The second look-up table 420 may include current ratios RofWmc, GofWmc, and BofWmc that represent a correlation between the first through third currents Rsc, Gsc, and Bsc. Here, each of the current ratios RofWmc, GofWmc, and BofWmc may be a proportion of a certain current to the total driving current.

For example, when the first current Rsc corresponding to a grayscale 228 is 17.6743 mill ampere (mA), the second current Gsc is 23.6063 mill ampere (mA), the third current Bsc is 44.5042 mill ampere (mA), and the total driving current Wmc_Log is 85.7848 mill ampere (mA), a first current ratio RofWmc of the first current Rsc may be 0.2060 (e.g., the first current Rsc/the total driving current Wmc_Log=17.6743/85.7548=0.2060). The current ratios RofWmc, GofWmc, and BofWmc may be used to calculate the reference driving current IREF.

Referring again to FIG. 3, the reference current calculating unit 310 may calculate the average grayscale based on grayscales included in the first image data IMAGE1 and may calculate the reference driving current IREF based on the average grayscale and the look-up table (e.g., the second look-up table 420).

In some example embodiments, the reference current calculating unit 310 may generate average image data based on frame images and may calculate the average grayscale based on the average image data. That is, when the first image data IMAGE1 includes frame images, the reference current calculating unit 310 may normalize the frame images into the average image data and may normalize the average image data into one grayscale.

For example, the first image data IMAGE1 may include ten frame image groups, and one frame image group may include ten frame images. That is, the first image data IMAGE1 may include one hundred frame images. Here, the reference current calculating unit 310 may generate one group data based on ten frame images and may generate the average image data based on ten group images.

In some example embodiments, the reference current calculating unit 310 may generate one group image by calculating an arithmetic-mean of the frame images or by calculating a harmonic-mean of the frame images and may generate one average image data by calculating an arithmetic-mean of a group of images. For example, the reference current calculating unit 310 may generate one group image by calculating arithmetic-mean of ten frame images or by calculating harmonic-mean of ten frame images and may generate one average image data by calculating arithmetic-mean of ten group images.

Figure 4C:
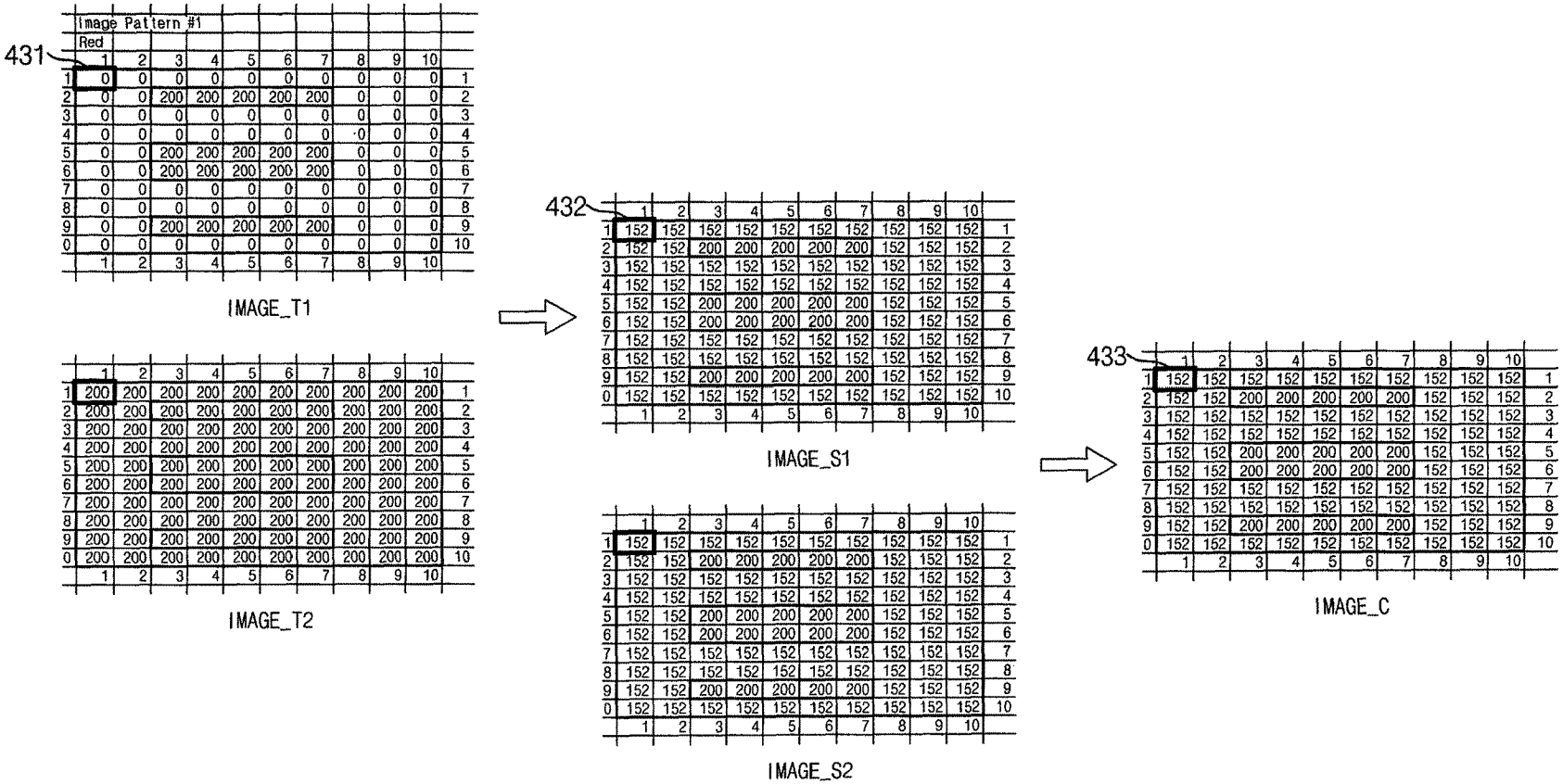
FIG. 4C is a diagram illustrating an example of average image data generated by the timing controller of FIG. 3.

FIG. 4C is a diagram illustrating an example of average image data generated by the timing controller of FIG. 3.

Referring to FIG. 4C, each of the frame images IMAGE_T1, IMGAE_T2, and etc may include one hundred grayscales (e.g., grayscales corresponding to pixels). However, the frame images are not limited thereto. For example, each of the frame images may include 1920*1080 numbers of grayscales.

In some example embodiments, the reference current calculating unit 310 may calculate a pixel average grayscale by averaging grayscales for the pixels and may generate average image data based on calculated pixel average grayscales. For example, when grayscales 431 for a first pixel included in the ten frame images IMAGE_T1, IMAGE_T2, and etc are 0, 200, 200, 200, 200, 200, 200, 200, 100, and 20, the reference current calculating unit 310 may calculate a first group grayscale 432 having 152 by averaging the grayscales.

In addition, when each of group grayscales 432 for a first pixel included in ten group images IMAGE_S1, IMAGE_S2, and etc is 152, the reference current calculating unit 310 may calculate a first pixel average grayscale 433 having 152 by averaging the group grayscales. Furthermore, the reference current calculating unit 310 may generate average image data IMAGE_C by respectively calculating one hundred number of pixel average grayscales.

In some example embodiments, the reference current calculating unit 310 may generate a group image by calculating harmonic meaning of a number of frame images (e.g., a predetermined number of frame images) and may generate average image data by calculating arithmetic meaning of a number of group images (e.g., a predetermined number of group images). For example, the reference current calculating unit 310 may generate a group image by sequentially calculating harmonic meaning of frame images that is sequentially provided in time and may generate average image data by calculating arithmetic meaning of group images that are sequentially generated.

FIG. 4D is a diagram illustrating another example of average image data generated by the timing controller of FIG. 3.

Referring to FIG. 4D, the reference current calculating unit 310 may generate three sub average image data 441, 442, and 443. As described with reference to FIG. 4A, when the pixels 111 include three types of sub pixels, the reference current calculating unit 310 may generate the sub average image data 441, 442, and 443 for each type of the sub pixels.

The first sub average image data 441 may be sub image data for the first pixels to display a first color, the second sub average image data 442 may be sub image data for the second pixels to display a second color, and the third sub average image data 441 may be sub image data for the third pixels to display a third color.

In some example embodiments, the reference current calculating unit 310 may calculate an average grayscale by averaging grayscales included in average image data 440. For example, the reference current calculating unit 310 may calculate a first average grayscale AG1 having 195 based on the first sub average image data 441, may calculate a second average grayscale AG2 having 195 based on the second sub average image data 442, and may calculate a third average grayscale AG3 having 195 based on the third sub average image data 443.

In some example embodiments, the reference current calculating unit 310 may calculate the reference driving current IREF based on the average grayscale. For example, the reference current calculating unit 310 may calculate the reference driving current IREF based on the first through third average grayscales AG1, AG2, and AG3 illustrated in FIG. 4D and the second look-up table 420 described with reference to FIG. 4B.

For example, the reference current calculating unit 310 may obtain the first through third currents Rmc, Gmc, and Bmc corresponding to the first through third average grayscales AG1, AG2, and AG3, may obtain first through third current ratios RoWmc, GofWmc, and BofWmc of the first through third currents Rmc, Gmc, and Bmic from the second look-up table 420, and may calculate the reference driving current IREF based on those (e.g., the first through third current ratios RofWmc, GofWmc, and BofWmc). For example, the first through third current ratio RofWm, GofWmc, and BofWmc are 0.2022, 0.2679, and 0.5300, and the reference driving current IREF corresponding to those (e.g., the first through third current ratio RofWm, GofWmc, and BofWmc) may be 56.0835 mill amperes (mA).

Referring again to FIG. 3, the degradation ratio calculating unit 320 may calculate a degradation ratio DR of each of the pixels 111 based on the first image data IMAGE1. In an example embodiment, the degradation ratio calculating unit 320 may calculate the degradation ratio DR of each of the pixels 111 based on a total sum (or, a total grayscale) of grayscales included in the first image data IMAGE1 and a grayscale for each of the pixels 111.

FIG. 4E is a diagram illustrating an example of a degradation ratio table generated by the timing controller of FIG. 3.

Referring to FIGS. 4D, 4F, and 4E, the degradation ratio calculating unit 320 may calculate the degradation ratio DR by calculating a ratio of a pixel average grayscale of each of the pixels 111 to the total grayscale of the average image data 440. Here, the degradation ratio DR may represent a relative degradation degree of a certain pixel, and sum of degradation ratios DR may be constant. For example, the degradation ratio calculating unit 320 may calculate a first degradation ratio 451*a* having 0.0097 by dividing the first pixel average grayscale 433 having 194 illustrated in FIG. 4D with a total sum of pixel average grayscales illustrated in FIG. 4D.

In an example embodiment, the degradation ratio calculating unit 320 may calculate the degradation ratio DR of each of the pixels 111 by diving pixel average grayscales with the average grayscale, respectively. For example, the degradation ratio calculating unit 320 may calculate the first degradation ratio 451*a* having 0.0097 by dividing the first pixel average grayscale 433 having 194 with the first average grayscale AG1 (or, a value multiplied the first average grayscale AG1 with a number of pixels 111) having 195.

In some example embodiments, the degradation ratio calculating unit 320 may generate first through third degradation ratio tables 451, 452, and 453 for the first through the third sub pixels. The first through third degradation ratio tables 451, 452, and 453 may be used to calculate a pixel degradation current.

Referring again to FIG. 3, the compensating unit 330 may calculate the degradation current based on the reference driving current IREF and the measured driving current ISEN and may calculate a pixel degradation current of each of the pixels 111 based on the degradation current and the degradation ratio DR.

FIG. 4F is a diagram illustrating an operation of compensating unit included in the timing controller of FIG. 3. FIG. 4G is a diagram illustrating an example of a pixel degradation current generated by the timing controller of FIG. 3.

Referring to FIGS. 4F and 4G, as described with reference to FIG. 4D, the reference driving current IREF may be 56.0835 mill ampere (mA), and the measured driving current ISEN may be 50.1241 mill ampere (mA). Here, the measured driving current ISEN may be an average current that is measured at a time (or, during a period) in which the first image data IMAGE1 is provided. For example, the measured driving current ISEN may have an average value of driving currents that are measured during one hundred number of frame images are provided.

The compensating unit 330 may generate the degradation current by calculating a difference between the reference driving current IREF and the measured driving current ISEN. For example, when the reference driving current IREF is 56.0835 mill ampere (mA) and the measured driving current ISEN is 50.1241 mill ampere (mA), the degradation current may be 5.9595 mill ampere (mA) (e.g., 56.0835 mA-50.1241 mA).

The compensating unit 330 may calculate first through third degradation currents based on the degradation current and grayscale ratios of the first through third average grayscales. Here, the first through third degradation currents may be degradation currents for the first through third sub pixels. As illustrated in FIG. 4F, the compensating unit 330 may calculate the grayscale ratios (e.g., 0.0335, 0.3333, and 0.3334) of the first through third average grayscales and may calculate the first through third degradation currents (ΔI_RGB) (e.g., 1.9875, 1.9863, and 1.9869) based on the degradation current and the grayscale ratios.

The compensating unit 330 may calculate pixel degradation currents 470 of the pixels 111 based on the degradation currents ΔI_RGB illustrated in FIG. 4F and the degradation ratio table 450. For example, the compensating unit 330 may calculate the pixel degradation currents 470 illustrated in FIG. 4G based on the first through third degradation currents R_BURNDELTA, G_BURNDELTA, and B_BURNDELTA and the degradation ratio tables 451, 452, and 453 illustrated in FIG. 4E. Because the degradation ratio DR represents a relative degradation degree of a certain pixel, the compensating unit 330 may divide the degradation current to the pixels based on the degradation ratio DR. For example, a first pixel degradation current 471 of a first pixel may be 0.019300 mill ampere (mA) (e.g., 1.9875 mA*0.0097).

The compensating unit 330 may calculate an offset grayscale of each of the pixels 111 based on the pixel degradation currents 470. Here, the offset grayscale may be a grayscale, which is added to each of grayscales included in the image data, for compensating the luminance reduction due to a pixel degradation. The compensating unit 330 may calculate the offset grayscale corresponding to the pixel degradation currents 470 based on a grayscale-current characteristic (a variation characteristic of a driving current according to a change of a grayscale) of a pixel. The compensating unit 330 may generate a compensating grayscale table based on calculated offset grayscales.

FIG. 4H is a diagram illustrating an example of a compensation grayscale table generated by the timing controller of FIG. 3.

Referring to FIG. 4H, a first offset grayscale 481*a* of the first pixel, which corresponds to the first degradation current 471 having 0.019300, is 10, and a second offset grayscale of a second pixel, which corresponds to a second degradation current having 0.023700, is 12.

The compensating unit 330 may generate first through third compensating grayscale tables 481, 482, and 483. Here, the first through third compensating grayscale tables 481, 482, and 483 may be compensating grayscale tables for the first through third sub pixels. The first through third compensating grayscale tables 481, 482, and 483 may include offset grayscales for each of the sub pixels.

The compensating unit 330 may generate a compensating grayscale curve of each of the pixels 111 based on the offset grayscale. Here, the compensating grayscale curve may represent a relation between a predetermined grayscale and a compensation grayscale (or, a compensated grayscale), where the compensation grayscale may have a grayscale value that is compensated based on the offset grayscale.

Figure 5:
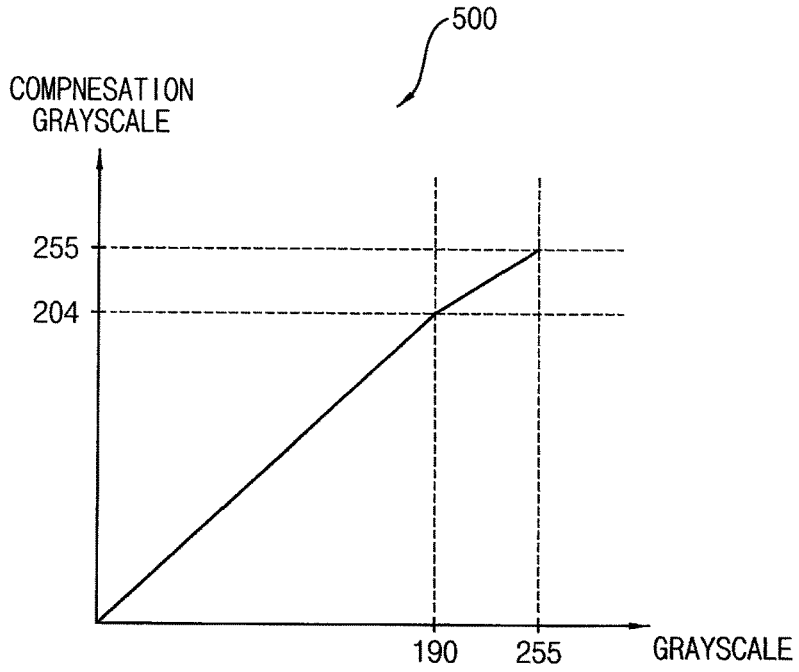
FIG. 5 is a diagram illustrating an example of a compensation grayscale curve generated by the timing controller of FIG. 3.

FIG. 5 is a diagram illustrating an example of a compensation grayscale curve generated by the timing controller of FIG. 3.

Referring to FIG. 5, the compensating unit 330 may convert a certain grayscale included in the image data into a compensation grayscale based on the offset grayscale.

For example, the compensating unit 330 may convert a grayscale 433 of a first pixel having 194 illustrated in FIG. 4D into a compensation grayscale of 204 (i.e., a first grayscale of a first pixel+an offset grayscale of the first pixel=194+10=204). For example, the compensating unit 330 may convert a grayscale of a second pixel having 200 illustrated in FIG. 4D into a compensation grayscale of 200.

The compensating unit 330 may compensate second image data IMAGE3 based on the compensation grayscale curve 500. Here, the second image data IMAGE3 may be image data that is provided after the compensation grayscale curve is generated (or, after the offset grayscale is calculated). For example, the compensating unit 330 may compensate a grayscale of 194 included in the second image data IMAGE3 as a compensation grayscale of 204. For example, the compensating unit 330 may compensate a grayscale of 97 included in the second image data IMAGE3 as a compensation grayscale of 102 according to the compensation grayscale curve 500.

Because a maximum grayscale used in the display device 100 may be predetermined, the compensating unit 330 may generate the compensation grayscale curve 500 with respect to an average grayscale and may compensate image data based on the compensation grayscale curve 500.

In an example embodiment, the display device 100 may repeatedly generate the compensation grayscale curve 500 with a certain period. That is, the display device 100 may update the compensation grayscale curve 500 with a certain period.

As described above, the timing controller 160 may calculate the reference driving current IREF and the degradation ratio DR of each of the pixels 111 based on image date and may calculate the offset grayscale for each of the pixels 111 based on the measured driving current ISEN, the reference driving current IREF, and the degradation ratio DR. Therefore, the display device 100 may compensate degradation of a pixel (or, degradation of each of the pixels 111).

Figure 6:
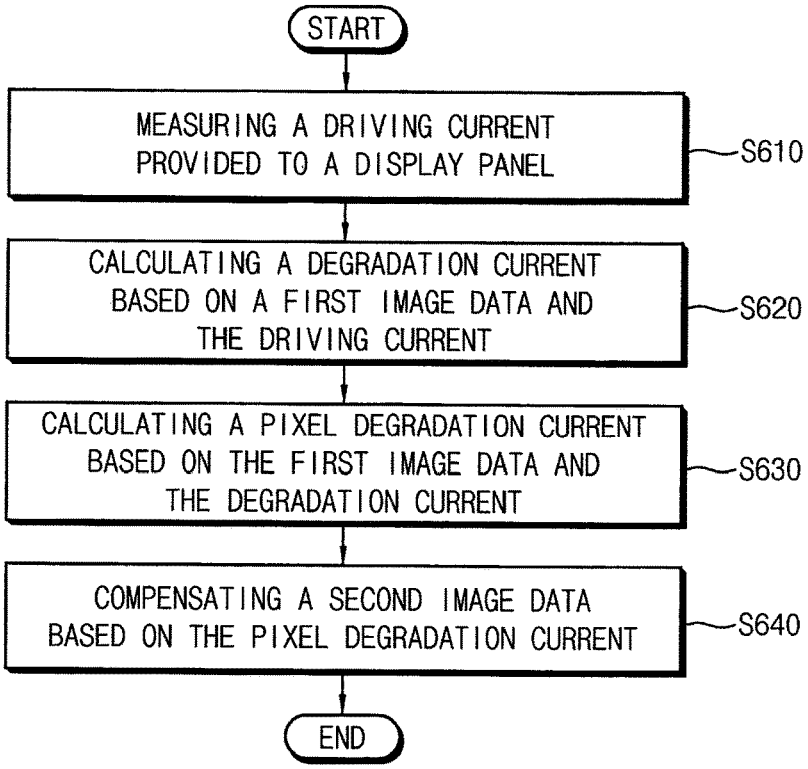
FIG. 6 is a flowchart illustrating a method of compensating degradation of a display panel according to some example embodiments of the present invention.

FIG. 6 is a flowchart illustrating a method of compensating degradation of a display panel according to example embodiments.

Referring to FIGS. 1, 3, and 6, the method of FIG. 6 may be performed by the display device 100. The method of FIG. 6 may measure a driving current provided to the display panel 110 (S610). The method of FIG. 6 may measure the driving current (or, a returned current) that is returned from the display panel 110 to the power supplier 140 through a second power supplying lines.

The method of FIG. 6 may calculate a degradation current based on first image data IMAGE2 and the driving current ISEN that is measured (S620). The first image data may be image data provided from an outside (or, from an external component) at a certain time or during a certain period. When the display device 100 performs compensating a degradation with a certain period, the first image data IMAGE1 may be image data provided to the display device 100 during a first period, and second image data IMAGE2 may be image data provided during a second period (e.g., a next period of the first period). For example, the method of FIG. 6 may calculate a reference driving current IREF based on image data (or, the first image data IMAGE1) and may calculate the degradation current based on driving current ISEN and the reference driving current IREF.

The method of FIG. 6 may calculate a pixel degradation current of each of the pixels 111 based on the first image data IMAGE1 and the degradation current (S630). For example, the method of FIG. 6 may calculate a degradation ratio DR of each of the pixels 111 based on grayscales (or, grayscale values) included in the image data IMAGE1 and may calculate the pixel degradation current of each of the pixels 111 based on the degradation current and the degradation ratio DR.

The method of FIG. 6 may compensate the second image data IMAGE2 based on the pixel degradation current. For example, the method of FIG. 6 may calculate an offset grayscale of each of the pixels 111 based on the degradation current and a grayscale-current characteristic (e.g., a variation characteristic of the driving current according to a change of a grayscale) of a pixel, may generate a degradation compensation curve 500 of each of the pixels 111 based on the offset grayscale, and may compensate grayscales (or, grayscale include in the second image data IMAGE2) for the pixels 111 based on the degradation compensation curve 500.

Figure 7:
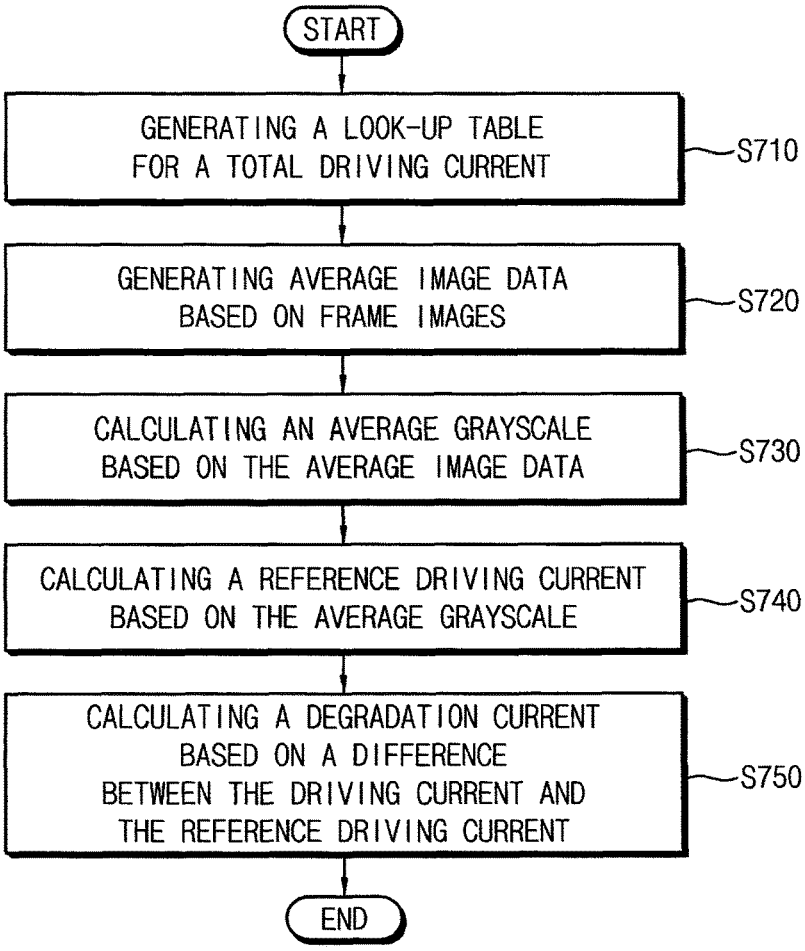
FIG. 7 is a flowchart illustrating an example in which a degradation current is calculated by the method of FIG. 6.

FIG. 7 is a flowchart illustrating an example in which a degradation current is calculated by the method of FIG. 6.

Referring to FIGS. 1, 3, and 7, the method of FIG. 7 may calculate the reference driving current IREF based on the first image data IMAGE1.

The method of FIG. 7 may generate a look-up table for a total driving current (S710). The method of FIG. 7 may calculate the total driving current for each of grayscales based on currents, which are pre-measured, for sub pixels included in the pixels 111 and may generate the look-up table based on the total driving current for each of grayscales. The method of FIG. 7 may calculate first through third currents by removing a loading effect between the currents from pre-measured currents for each of the sub pixels.

As described with reference to FIG. 4A, the method of FIG. 7 may calculate the total driving current Wmc for each of grayscales by summing the first through third currents Rsc, Gsc, and Bsc. As described with reference to FIG. 4B, the method of FIG. 7 may calculate current ratios RofWmc, GofWmc, and BofWmc of the first through third currents Rsc, Gsc, and Bsc. The method of FIG. 7 may generate a second look-up table 420 that includes the total driving current Wmc and the current ratios RofWmc, GofWmc, and BofWmc of the first through third currents Rsc, Gsc, and Bsc.

The method of FIG. 7 may generate average image data based on frame images (S720), and may calculate an average grayscale based on the average image data (S730). For example, the method of FIG. 7 may generate one group image based on ten (or, ten number of) frame images and may generate one average image data based on ten (or, ten number of) group images. The method of FIG. 7 may generate the group image and the average image data by using arithmetic meaning and/or harmonic meaning.

In an example embodiment, the method of FIG. 7 may calculate the average grayscale for each of images. For example, when the first image data IMAGE1 includes RGB data, the method of FIG. 7 may calculate the average grayscale for each of images (e.g., a red image, a green image, and a blue image).

The method of FIG. 7 may calculate a reference driving current based on the average grayscale (S740). The method of FIG. 7 may obtain the total driving current corresponding to the average grayscale from a look-up table that is predetermined (or, pre-generated).

In an example embodiment, the method of FIG. 7 may calculate a current ratio for each of images for the average grayscale and may calculate the reference driving current based on the current ratio for the average grayscale. For example, when the first image IMAGE1 has RGB data, the method of FIG. 7 may calculate the current ratio for each of the images (e.g., a red image, a green image, and a blue image) based on the average grayscale of each of the images and may obtain the total driving current (or, the reference driving current) corresponding to the current ratio from a look-up table that is predetermined (or, pre-generated).

The method of FIG. 7 may calculate a degradation current based on a difference between the driving current (or, a measured driving current) and the reference driving current (S750). For example, the method of FIG. 7 may determine the degradation current with the difference between the driving current and the reference driving current.

Figure 8:
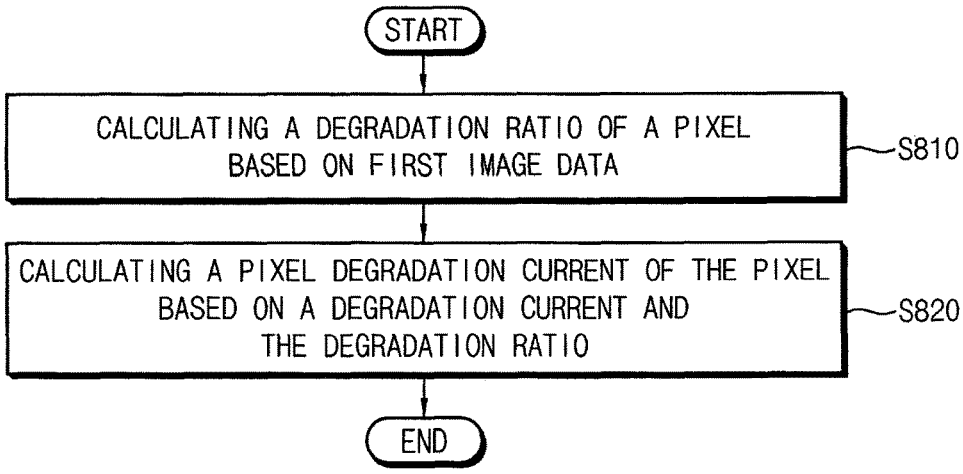
FIG. 8 is a flowchart illustrating an example in which a pixel degradation current is calculated by the method of FIG. 6.

FIG. 8 is a flowchart illustrating an example in which a pixel degradation current is calculated by the method of FIG. 6.

Referring to FIGS. 1, 3, and 8, the method of FIG. 8 may calculate a degradation ratio DR of each of the pixels 111 based on the first image data IMAGE1. When the first image data IMAGE1 includes frame images, the method of FIG. 8 may generate an average image data based on the frame images and may calculate the degradation ratio DR of each of the pixels 111 based on the average image data.

As described with reference to FIG. 4E, the method of FIG. 8 may calculate a ratio of the average grayscale of each of the pixels 111 to a total grayscale (or, sum of grayscales) of the average image data and may determine the degradation ratio DR as the ratio.

The method of FIG. 8 may calculate a pixel degradation current of each of the pixels 111 based on the degradation ratio DR and the degradation current. As described with reference to FIG. 4G, the method of FIG. 8 may divide the degradation current for the pixels 111 based on the degradation ratio.

As described with reference to FIGS. 6 through 8, the method of compensating a degradation according to example embodiments may measure a driving current (or, a total driving current) that is provided to the display panel 110 and may calculate the reference driving current and the degradation ratio of each of the pixels 111 based on image data (or, the first image data IMAGE1). In addition, the method may calculate the offset grayscale of each of the pixels based on the driving current (or, the total driving current), the reference driving current, and the degradation ratio. Therefore, the method may respectively compensate a degradation of each of the pixels 111 even though the display device 100 has a one-channel current sensing configuration.

Figure 9:
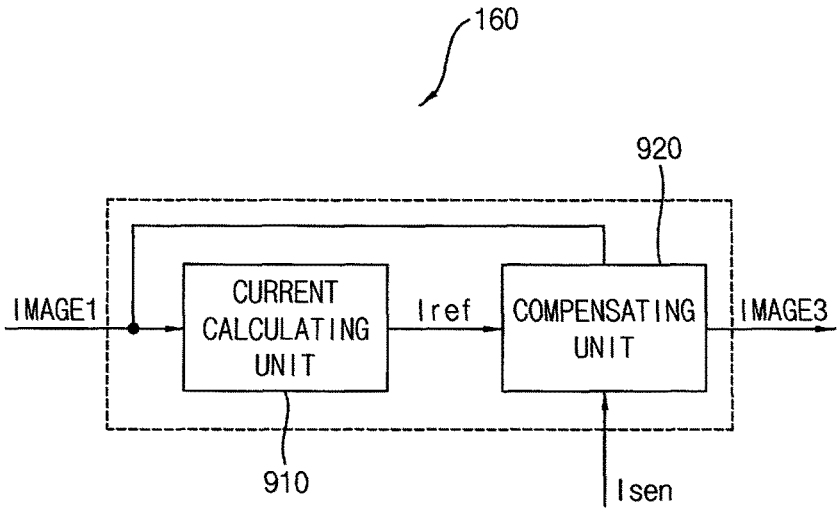
FIG. 9 is a diagram illustrating an example of the timing controller included in the display device of FIG. 1 according to some example embodiments of the present invention.

FIG. 9 is a diagram illustrating another example of the timing controller included in the display device of FIG. 1.

Referring to FIGS. 1 and 9, the timing controller 160 may calculate a reference driving current Iref based on image data, may calculate a degradation current based on a driving current measured by the current sensor 150 and the reference driving current Iref, and may compensate a degradation prediction profile based on the degradation current.

As illustrated in FIG. 9, the timing controller 160 may include a reference current calculating unit 910 and a compensating unit 920.

The reference current calculating unit 910 may be substantially the same as or similar to the reference current calculating unit 310 described with reference to FIG. 3. Therefore, some duplicated description will not be repeated.

The compensating unit 920 may calculate the degradation current based on the driving current Isen and the reference driving current Iref. For example, the compensating unit 920 may determine the degradation current by calculate a difference between the reference driving current Iref and the driving current Isen. A configuration of calculating the degradation current may be substantially the same as or similar to a configuration of calculating the degradation current by the compensating unit 330 described with reference to FIG. 3. Therefore, some duplicated description will not be repeated.

The compensating unit 920 may compensate the degradation prediction profile based on the degradation current. Here, the degradation prediction profile may include luminance degradation of a pixel (or, the display panel 110) in time. The degradation prediction profile may be predetermined in a manufacturing process of the display device 100. In some example embodiments, the compensating unit 920 may calculate a degradation time constant based on the degradation current and may compensate the degradation prediction profile based on the degradation time constant. Here, the degradation time constant may represent a change (or, a variation) of the degradation current in time.

The compensating unit 920 may compensate the second image data IMAGE2 based on the degradation prediction profile that is compensated.

Figure 10:
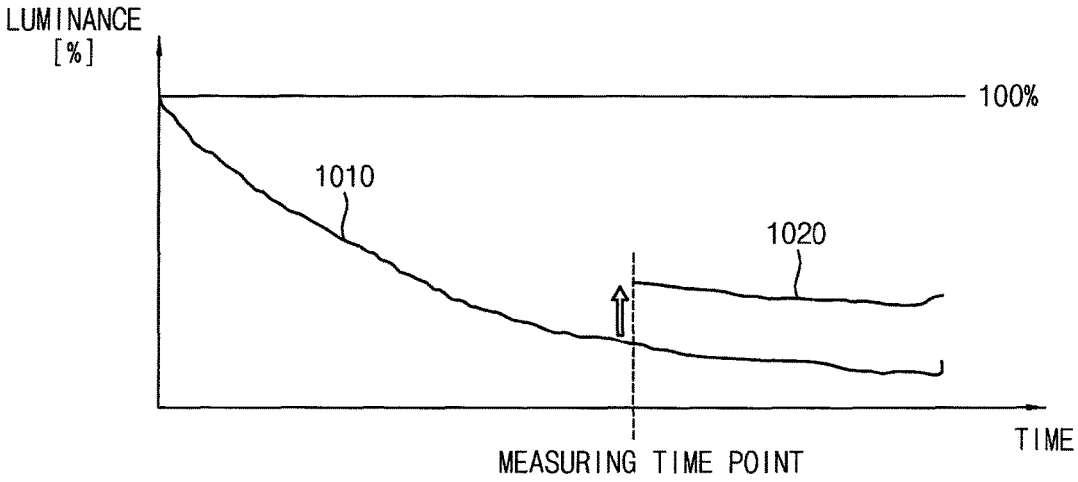
FIG. 10 is a diagram illustrating an example of a degradation predicting profile generated by the timing controller of FIG. 9.

FIG. 10 is a diagram illustrating an example of a degradation predicting profile generated by the timing controller of FIG. 9.

Referring to FIGS. 1, 9 and 10, luminance of a pixel may be reduced in time. That is, a pixel that receives a constant grayscale (or, a constant data signal) may emit light with a reduced luminance in time according to the pixel is used, instead of a constant luminance. A ratio of luminance reduction may be substantially the same as or similar to a ratio of a degradation current to a reference driving current.

The compensating unit 920 may calculate a degradation time constant based on a change of the degradation current in time and may compensate the degradation prediction profile to have a slope (of a degradation prediction curve) of which value is substantially the same as a value of the degradation time constant. For example, a first degradation prediction profile may have a first slope at a first time point. Here, the compensating unit 920 may calculate a second slope at the first time point, where the second slope is different from the first slope. As illustrated in FIG. 10, a first degradation curve 1010, which is generated by the first degradation prediction profile, having the first slope may be different from a second degradation curve 1020, which is measured, having the second slope. Therefore, the compensating unit 920 may compensate the degradation prediction profile (or, the first degradation prediction profile) to have the second slope.

The compensating unit 920 may compensate image data based on a compensated degradation prediction profile. That is, the compensating unit 920 may predict that degradation having a certain vale occurs when a certain time elapses, based on the compensated degradation prediction profile, and may compensate the image data to compensate the degradation (or, a predicted degradation).

As described above, the display device 100 according to example embodiments may compensate the degradation prediction profiled based on a measured total driving current. Therefore, the display device 100 may exactly (or accurately, or relatively accurately) compensate degradation considering (or based on) a change of a driving condition of the display device 100.

Figure 11:
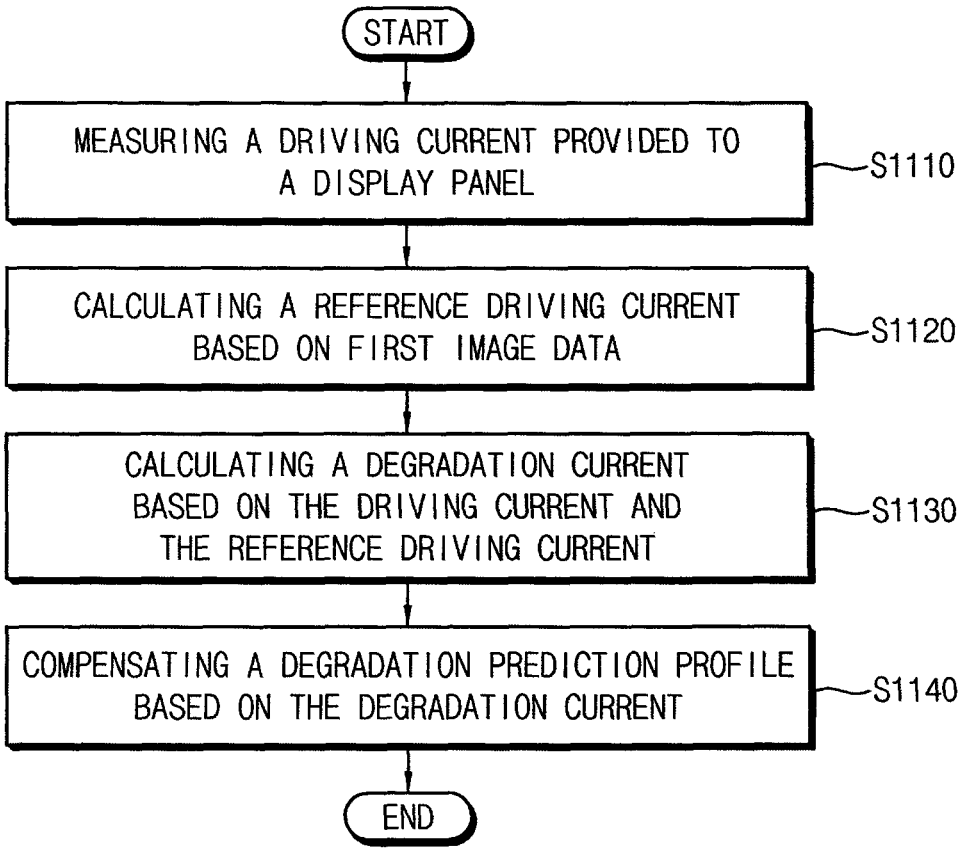
FIG. 11 is a flowchart illustrating a method of compensating degradation of a display panel according to some example embodiments of the present invention.

FIG. 11 is a flowchart illustrating a method of compensating degradation of a display panel according to example embodiments.

Referring to FIGS. 1, 9 and 11, the method of FIG. 11 may measure a driving current provided to the display panel 110 (S1110).

The method of FIG. 11 may calculate a reference driving current based on image data (S1120).

The method of FIG. 11 may calculate a degradation current based on the driving current (or, a measure driving current) and the reference driving current (S1130).

For example, the method of FIG. 11 may determine the degradation current by calculating a difference between the reference driving current and the driving current.

The method of FIG. 11 may compensate a degradation prediction profile based on the degradation current (S1140). In some example embodiments, the method of FIG. 11 may calculate a degradation time constant based on the degradation current and may compensate the degradation prediction profile based on the degradation time constant.

The method of FIG. 11 may compensate the image data based on a compensated degradation prediction profile.

As described above, the method of compensating a degradation according to example embodiments may compensate the degradation prediction profile based on a measured total driving current and may compensate the image data based on the compensated degradation prediction profile. Therefore, the method may exactly (or accurately, or relatively accurately) compensate for degradation considering (or based on) a change of a driving condition of the display device 100.

Aspects of embodiments of the present invention may be applied to any display device (e.g., an organic light emitting display device, a liquid crystal display device, etc). For example, embodiments of the present invention may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and aspects of example embodiments. Accordingly, all such modifications are intended to be included within the scope of example embodiments as defined in the claims, and their equivalents. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims, and their equivalents. The present invention is defined by the following claims, with equivalents of the claims to be included therein.

What is claimed is:

1. A display device comprising:

a display panel comprising a pixel;

a current sensor configured to measure a driving current provided to the display panel; and a timing controller configured to calculate a reference driving current and a degradation ratio of the pixel based on first image data provided to the display panel and to compensate second image data based on the driving current, the reference driving current, and the degradation ratio of the pixel, wherein the degradation ratio represents a ratio of an amount of luminance degradation of the pixel to an amount of luminance degradation of the display panel.

2. The display device of claim 1, further comprising:

a power supply configured to provide first and second power voltages to the display panel through first and second power supply lines, wherein the current sensor is configured to measure the driving current that is returned from the display panel to the power supply through the second power supply line.

3. The display device of claim 1, wherein the first image data comprises frame images, and wherein the timing controller is configured to generate average image data based on the frame images and to calculate the reference driving current and the degradation ratio based on the average image data.

4. The display device of claim 1, wherein the timing controller is configured to calculate the degradation ratio based on a total sum of grayscales included in the first image data and a grayscale for the pixel among the grayscales.

5. The display device of claim 1, wherein the timing controller is configured to calculate an average grayscale based on grayscales included in the first image data and to calculate the reference driving current based on the average grayscale.

6. The display device of claim 5, wherein the timing controller comprises a look-up table comprising respective real driving current values for each of average grayscales of the first image data and is configured to determine the reference driving current by selecting one of the real driving current values based on the average grayscale.

7. The display device of claim 1, wherein the timing controller is configured to calculate a degradation current based on the reference driving current and the driving current.

8. The display device of claim 7, wherein the timing controller is configured to calculate a pixel degradation current of the pixel based on the degradation ratio and the degradation current.

9. The display device of claim 8, wherein the timing controller is configured to calculate an offset grayscale of the pixel based on the pixel degradation current, and wherein the offset grayscale is added to a grayscale for the pixel included in the first image data.

10. The display device of claim 9, wherein the timing controller is configured to calculate a compensation grayscale curve that includes a degradation compensation value of the pixel for each of grayscales based on the offset grayscale.

11. The display device of claim 10, wherein the timing controller is configured to compensate the second image data based on a degradation compensation curve.

12. The display device of claim 7, wherein the timing controller is configured to compensate a degradation prediction profile based on the degradation current, and wherein the degradation prediction profile comprises a luminance degradation rate of the display panel with time.

13. The display device of claim 12, wherein the timing controller is configured to calculate a degradation time constant, which represents a change of the degradation current with time, based on the degradation current and to compensate the degradation prediction profile based on the degradation time constant.

14. A display device comprising:

a display panel comprising a pixel;

a current sensor configured to measure a driving current provided to the display panel; and a timing controller configured to calculate a reference driving current based on first image data provided to the display panel, to calculate a degradation current based on the driving current and the reference driving current, and to compensate a degradation prediction profile based on the degradation current and a degradation ratio of the pixel, wherein the degradation ratio represents a ratio of an amount of luminance degradation of the pixel to an amount of luminance degradation of the display panel, wherein the degradation prediction profile comprises a luminance degradation rate of the display panel with time.

15. The display device of claim 14, wherein the timing controller is configured to calculate a degradation time constant, which represents a change of the degradation current with time, based on the degradation current and to compensate the degradation prediction profile based on the degradation time constant.

16. The display device of claim 15, wherein the timing controller is configured to compensate second image data based on a compensated degradation prediction profile.

17. A method of compensating a degradation of a display panel, the method comprising:

measuring a driving current provided to the display panel that comprises a pixel;

calculating a degradation current based on the driving current and first image data that is provided to the display panel;

calculating a pixel degradation current of the pixel based on the first image data, the degradation current, and a degradation ratio of the pixel, wherein the degradation ratio represents a ratio of an amount of luminance degradation of the pixel to an amount of luminance degradation of the display panel; and compensating second image data based on the pixel degradation current.

18. The method of claim 17, wherein calculating the degradation current comprises:

calculating a reference driving current based on the first image data; and calculating the degradation current based on a difference between the driving current and the reference driving current.

19. The method of claim 17, wherein calculating the pixel degradation current comprises:

calculating the degradation ratio of the pixel based on the first image data.

* * * * *